US006837472B1

(12) United States Patent
Beutz

(10) Patent No.: US 6,837,472 B1
(45) Date of Patent: Jan. 4, 2005

(54) RELEASABLE BOTTLE HOLDER

(76) Inventor: Michael J. Beutz, 7915 Quincy St., Minneapolis, MN (US) 55432

( * ) Notice: Subject to any disclaimer, the term of this patent is extended or adjusted under 35 U.S.C. 154(b) by 0 days.

(21) Appl. No.: 10/356,127

(22) Filed: Feb. 1, 2003

Related U.S. Application Data

(60) Provisional application No. 60/356,338, filed on Feb. 13, 2002.

(51) Int. Cl.[7] ..... A47K 1/08; A45F 3/16

(52) U.S. Cl. ..... 248/312; 248/689; 248/305; 248/229.1; 224/148.4; 224/148.6

(58) Field of Search ..... 248/312, 682, 248/689, 229.1, 229.16, 229.26, 231.81, 231.85, 313, 316.1, 316.7; 24/369, 243, 3.7, 3.12; 224/148.1, 148.4, 148.7, 584, 182, 269

(56) References Cited

U.S. PATENT DOCUMENTS

| | | | | | |
|---|---|---|---|---|---|
| 1,643,661 | A | * | 9/1927 | Kendall | 248/113 |
| 2,417,269 | A | * | 3/1947 | Robertson | 248/61 |
| 3,163,712 | A | * | 12/1964 | Cochran | 174/164 |
| 3,520,570 | A | * | 7/1970 | Christopher et al. | 294/27.1 |
| 3,913,187 | A | * | 10/1975 | Okuda | 24/484 |
| 4,084,778 | A | * | 4/1978 | Dominguez | 248/314 |
| 4,371,137 | A | * | 2/1983 | Anscher | 248/73 |
| 4,623,185 | A | * | 11/1986 | Thomas | 294/87.28 |
| 4,773,549 | A | * | 9/1988 | Avraham | 215/396 |
| 4,958,791 | A | * | 9/1990 | Nakamura | 248/74.1 |
| 5,044,583 | A | * | 9/1991 | Daigle et al. | 248/62 |
| 5,108,055 | A | * | 4/1992 | Kreinberg et al. | 248/71 |
| 5,346,271 | A | * | 9/1994 | Erickson | 294/87.2 |
| 5,423,501 | A | * | 6/1995 | Yu | 248/61 |
| 5,607,230 | A | * | 3/1997 | Protz, Jr. | 362/396 |
| 5,735,562 | A | * | 4/1998 | Borg | 294/87.2 |
| 5,806,904 | A | * | 9/1998 | Smith | 294/31.2 |
| 5,890,635 | A | * | 4/1999 | Wu et al. | 224/148.4 |
| 6,019,335 | A | * | 2/2000 | Sehati | 248/312 |
| D427,510 | S | * | 7/2000 | Gary et al. | D8/395 |
| 6,279,794 | B1 | * | 8/2001 | Miyazaki | 224/148.7 |
| D449,685 | S | * | 10/2001 | Morrison | D24/128 |
| 6,349,844 | B1 | * | 2/2002 | Betras | 220/709 |
| 6,352,235 | B2 | * | 3/2002 | Cizek | 248/692 |
| 6,533,148 | B1 | * | 3/2003 | Dahl | 224/148.6 |
| 6,571,429 | B2 | * | 6/2003 | Yeh | 24/16 PB |

FOREIGN PATENT DOCUMENTS

JP 2002347768 A * 12/2002

* cited by examiner

*Primary Examiner*—Anita M. King

(57) ABSTRACT

A water bottle holder has a body joined to convex curved legs that are releasably latched together to embrace the neck of the bottle. A clasp joined to the body has an arm, head, ear and lip surrounding an eye accommodating a belt clip. An enlarged member joined to the arm has surfaces for logos, designs, labels and printed materials.

28 Claims, 16 Drawing Sheets

RELEASABLE BOTTLE HOLDER

This appln. claims benefit of No. 60/356,338 filed Feb. 13, 2002.

FIELD OF THE INVENTION

The invention is in the art of holders for containers. The holders are releasable bottle holders.

BACKGROUND OF THE INVENTION

Persons engaged in recreational exercise activities, such as walking, hiking, bike riding and fishing, use bottled water or beverages to replenish body fluids. Bottles of water are placed in back packs, bags and coolers and consumed when needed. This met hod of accommodating bottled water is bulky, heavy and not convenient for most exercise activities. The bottle holder of the invention obviates the disadvantages of conventional methods of transporting bottled water with a person engaged in recreational exercise activities.

SUMMARY OF THE INVENTION

The invention is a holder for a conventional water and beverage container, such as a bottle, that is releasable connected to the bottle to allow a person to separate the bottle from the holder. The holder is a low cost, one-piece plastic or metal product having a body joined to convex curved legs adapted to fit around the neck of a bottle. A releasable latch on the outer ends of the legs holds the legs in biased engagement with the neck of the bottle. In one embodiment, the legs are biased in firm engagement with the neck of the bottle without a releasable latch. The holder has a clasp adapted to be connected to a belt clip of other devices so that the holder and bottle can be carried by a person. The clasp has an arm joined to the body. A head joined to the outer end of the arm has an ear. A flexible lip joined to the body extends toward the ear to close the eye of the clasp. The clasp in one embodiment of the holder is joined to the side of a bottle cap.

DESCRIPTION OF EMBODIMENTS OF THE RELEASABLE BOTTLE HOLDER

Figure 1:
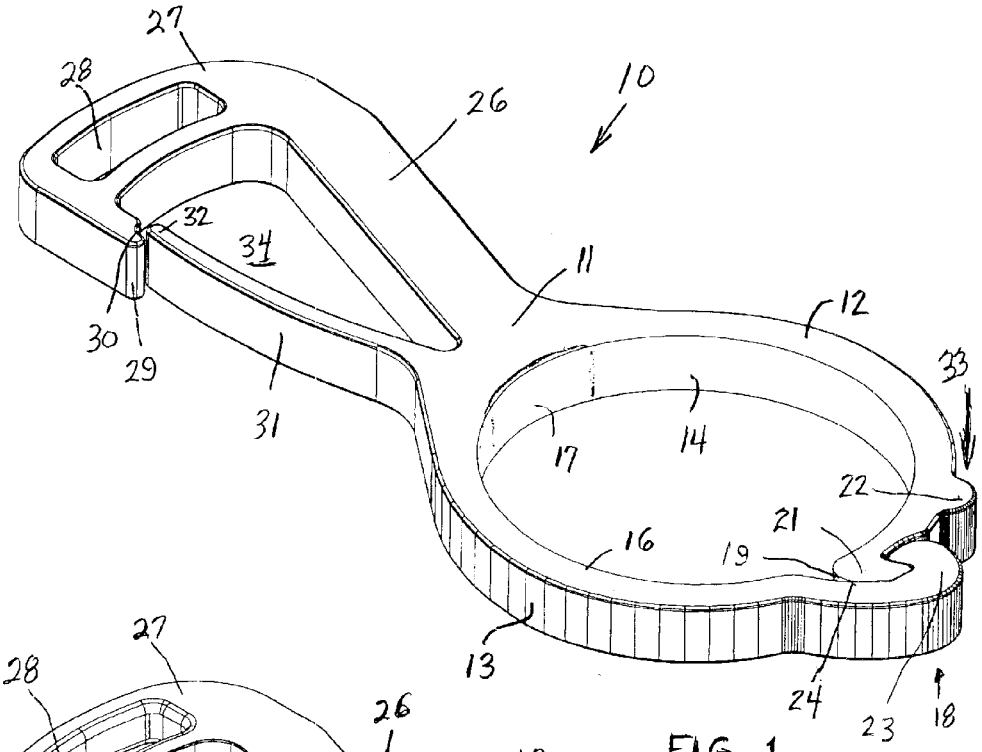
FIG. 1 is a perspective view of a releasable bottle holder of the invention.
Figure 2:
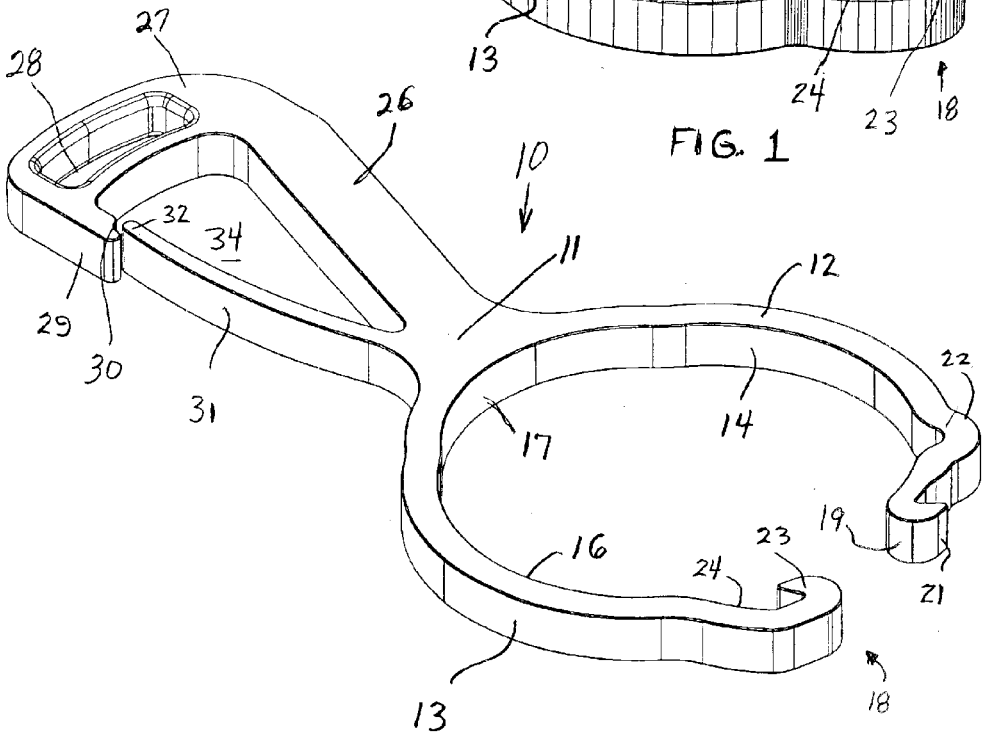
FIG. 2 is a perspective view of the holder of FIG. 1 in its open position.

A releasable bottle holder, indicated generally at 10, in FIGS. 1 to 6 is a one-piece device having a body 11 joined to convex curved legs 12 and 13. Legs 12 and 13 have generally semi-cylindrical inside walls 14 and 16 with adjacent ends joined to a concave wall 17 located at the base of body 11. The radius of curvature of wall 17 is smaller than the radius of curvature of wall 14. Wall 17 provides a concave recess at the base of body 11. The outer or free ends of legs 12 and 13 have a releasable connector or latch, indicated generally at 18, operable to hold legs 12 and 13 in a generally circular biased configuration, as seen in FIG. 1. Latch 18 has a convex curved outer end 19 of leg 12 terminating in an outwardly inclined toe or projection 21. A knob 22 joined to leg 12 is spaced from toe 21. Knob 22 is a semi-cylindrical projection extended automatically from an outer or free end of leg 12. An outwardly curved member, as shown at 1123 in FIG. 28, can be used as a knob to manually move leg 12 to release latch 18. The outer end of leg 13 has an inwardly directed hook 23 and an outwardly inclined inner surface or wall 24 extended toward the open portion of hook 23. As shown in FIG. 2, legs 12 and 13 are normally spaced apart with latch 18 in an open position. Legs 12 and 13 are flexible spring members that can be moved toward each other to engage hook 23 with projection 21, as shown in FIG. 1. Latch 18 is released by applying a force on knob 22 shown by arrow 33. The convex end 19 of leg 12 rides inwardly along inclined surface 24 to release projection 21 from hook 23. Flexible legs 12 and 13 move outwardly or away from each other when hook 23 is released from projection 21.

An arm 26 joined to body 11 opposite legs 12 and 13 terminates in a transverse head 27 having an ear 29 laterally spaced form arm 26. The inside of ear 29 has a recessed shoulder 30. Head 27 has an elongated slot 28 for accommodating a cord or strap. Arm 26, head 27 and ear 29 form a hook with an internal eye or space 34. A flexible lip 31 joined to body 11 extended toward ear 29 has an outer end 32 located adjacent the inside of shoulder 30 of ear 29. The outer end 32 of lip 31 is generally flush with ear 29 and not exposed to eye 34. Lip 31 is a leaf spring that is normally biased into engagement with ear 29. Lip 31 normally closes the entrance to eye 34 and prevents inadvertent release of a belt clip or other device looped through eye 34. Lip 31 is flexed inwardly to provide an opening into eye 34.

Bottle holder 10 is a one-piece flat device made of molded flexible plastic. Other materials, including metal and a combination of metal and plastic, can be used to make bottle holder 10.

Figure 3:
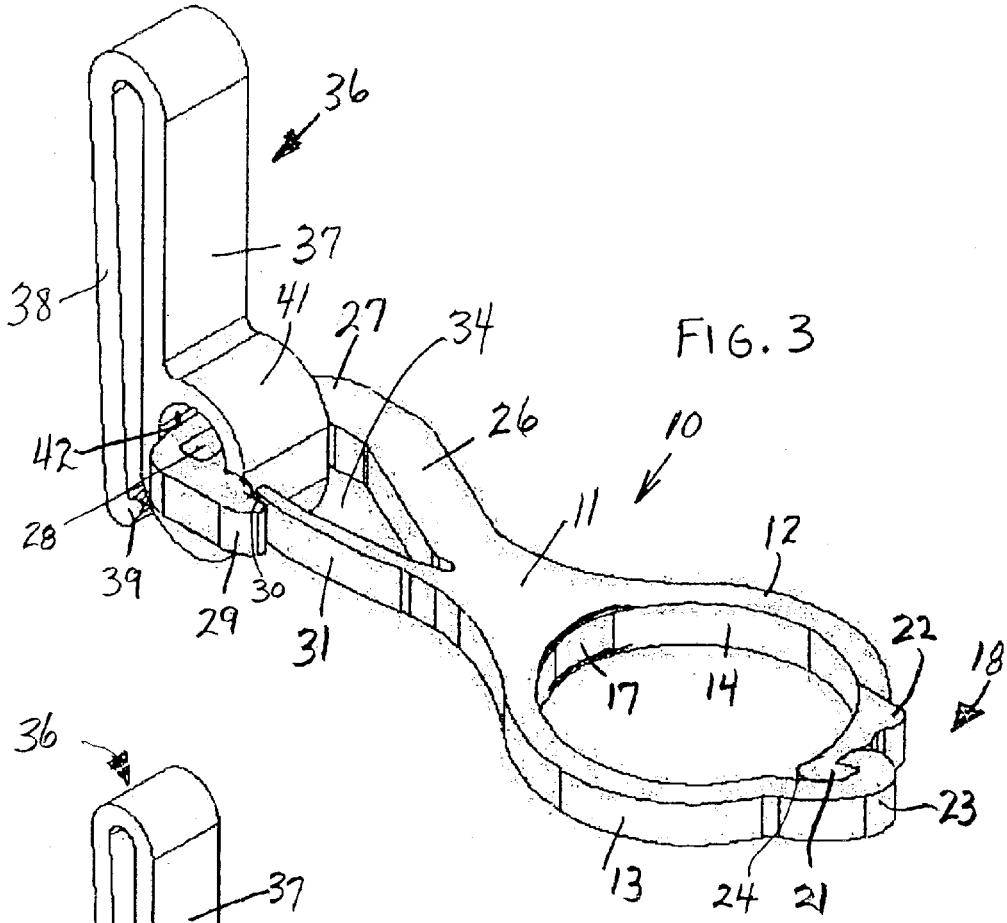
FIG. 3 is a perspective view of the releasable bottle holder of FIG. 1 attached to a belt clip.
Figure 4:
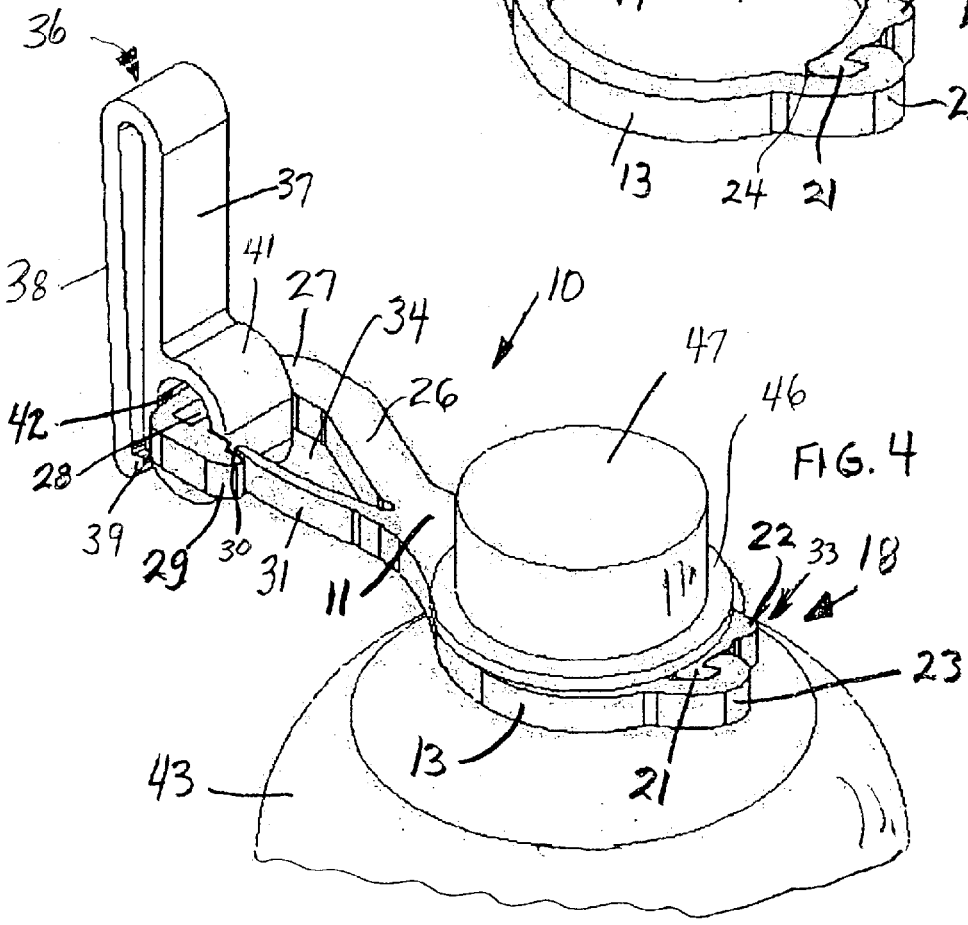
FIG. 4 is a perspective view of the releasable bottle holder and belt clip of FIG. 3 connected to the neck of a bottle.

As shown in FIGS. 3 and 4, bottle holder 10 is connected to a belt clip 36. Belt clip 36 is a one-piece plastic device having a flat front member 37 having an upper end turned downwardly and joined to a flat rear member 38. The lower end of member 38 has in inwardly directed transverse rib 39. Rib 39 faces a cylindrical member 41 joined to the lower end of front member 37. The upper end of member 41 can be spaced from front member 37 to allow member 41 to extend through slot 28. Cylindrical member 41 has a transverse hole 42 accommodating head 27 of holder 10 thereby pivotally connecting belt clip 36 to holder 10.

Figure 5:
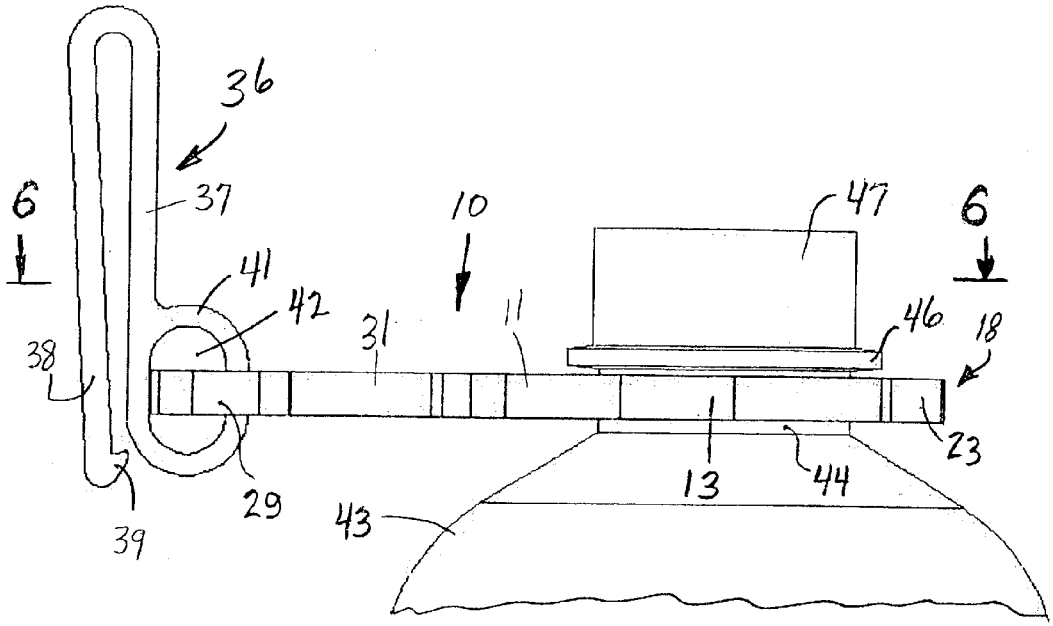
FIG. 5 is a side elevational view of FIG. 4.
Figure 6:
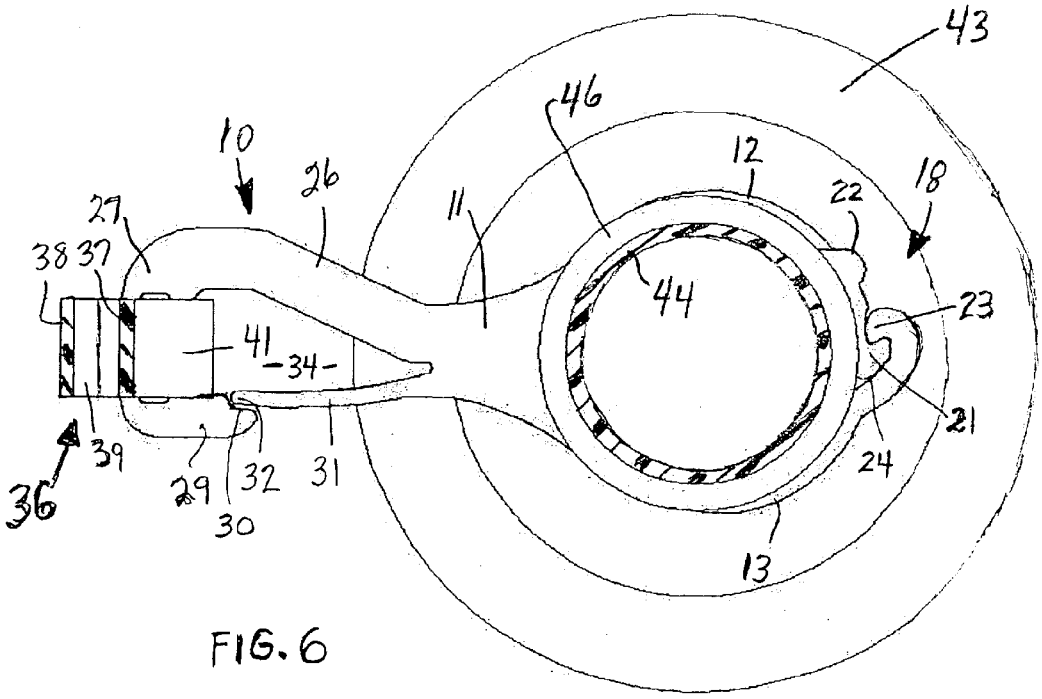
FIG. 6 is a sectional view taken along line 6—6 of FIG. 5.

As shown in FIGS. 4 to 6, holder 10 is connected to a bottle 43, such as a conventional 1- or 2-liter water or beverage bottle. Holder 10 can be connected to containers and flasks having necks. Bottle 43 has a tubular neck 44 having an outwardly directed annular flange or rim 46. A cap 47 threaded on the outer end of neck 44 closes the opening to the interior of bottle 43. Legs 12 and 13 embrace neck 44 below flange 46. Latch 18 in the lock position, as shown in FIG. 6, retains legs 12 and 13 around neck 44. When latch 18 is in the lock position, the inside convex walls 14 and 16 of legs 12 and 13 are located in a contiguous relationship with the cylindrical wall of neck 44. Latch 18 is released from neck 44 by applying a force, shown by arrow 33 on knob 22. This force moves neck 44 of bottle 43 into the recess provided by concave wall 17 at the base of body 11. This allows projection 21 to be moved inwardly out of engagement with hook 23 whereby the spring action of legs 12 and 13 expand the legs to an open position to allow the bottle to be removed from holder 10.

Figure 7:
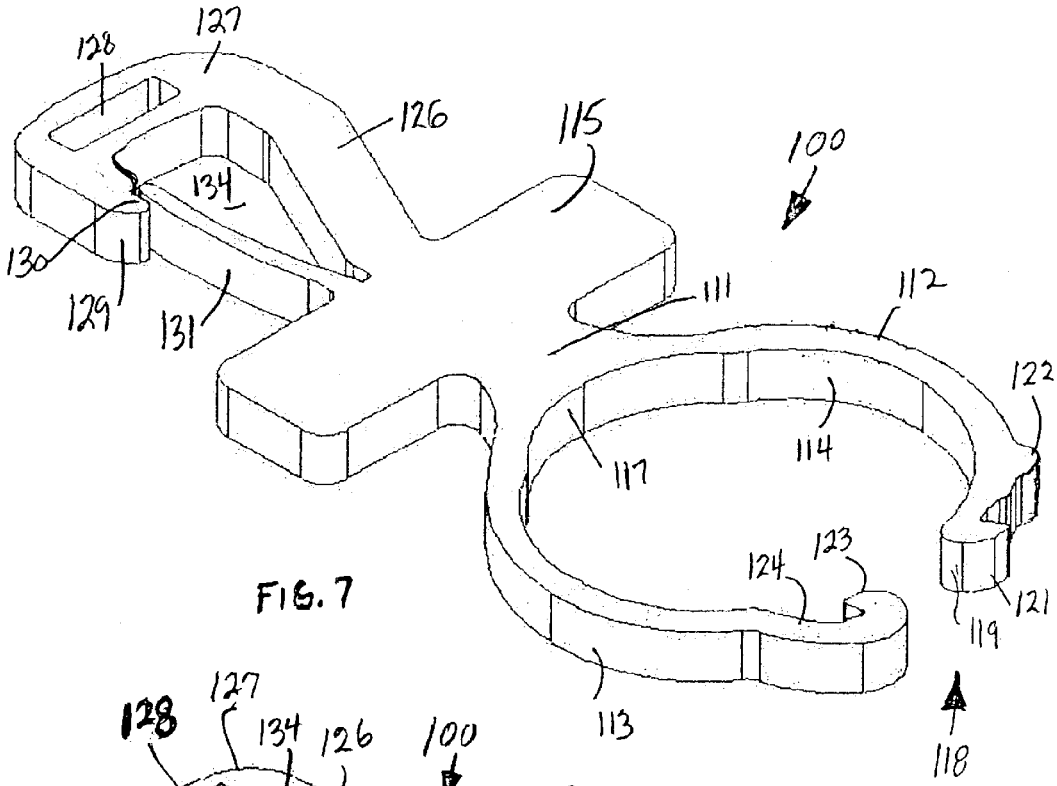
FIG. 7 is a perspective view of a first modification of the releasable bottle holder of FIG. 1.
Figure 8:
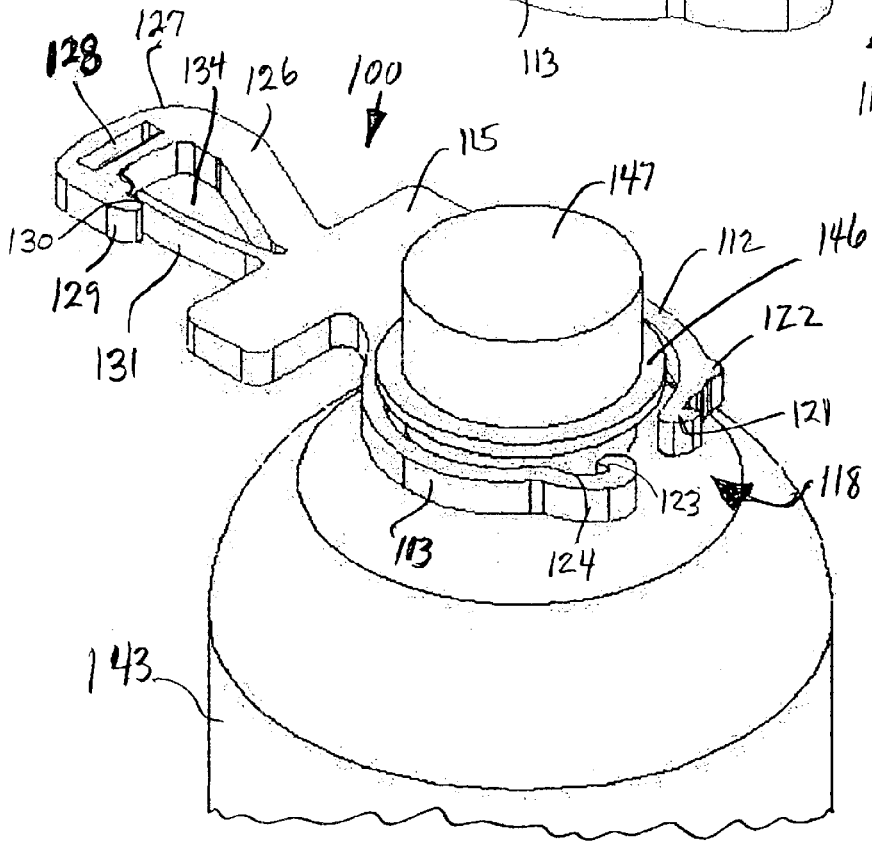
FIG. 8 is a perspective view of the releasable bottle holder of FIG. 7 connected to the neck of a bottle.

A first modification of the holder, indicated generally at 100, shown in FIGS. 7 and 8, is a one-piece plastic or metal device adapted to be connected to the neck of a bottle. The parts of holder 100 that correspond to holder 10 shown in FIGS. 1 to 6 have the same reference number with a prefix 1. Body 111 includes a transverse flat member 115 with exposed flat outer surfaces. Logos, designs, printed materials, labels and other visual indicia may be applied to or mounted on the flat surface of member 115.

Figure 9:
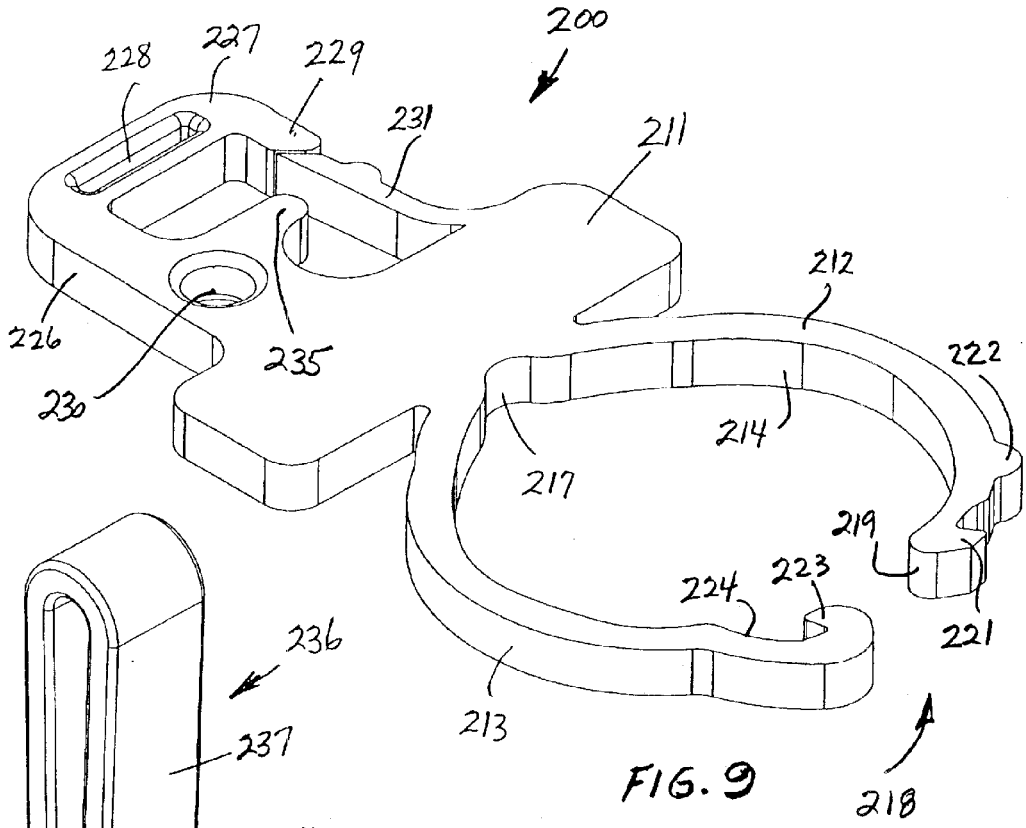
FIG. 9 is a perspective view of a second modification of the releasable bottle holder of the invention.
Figure 10:
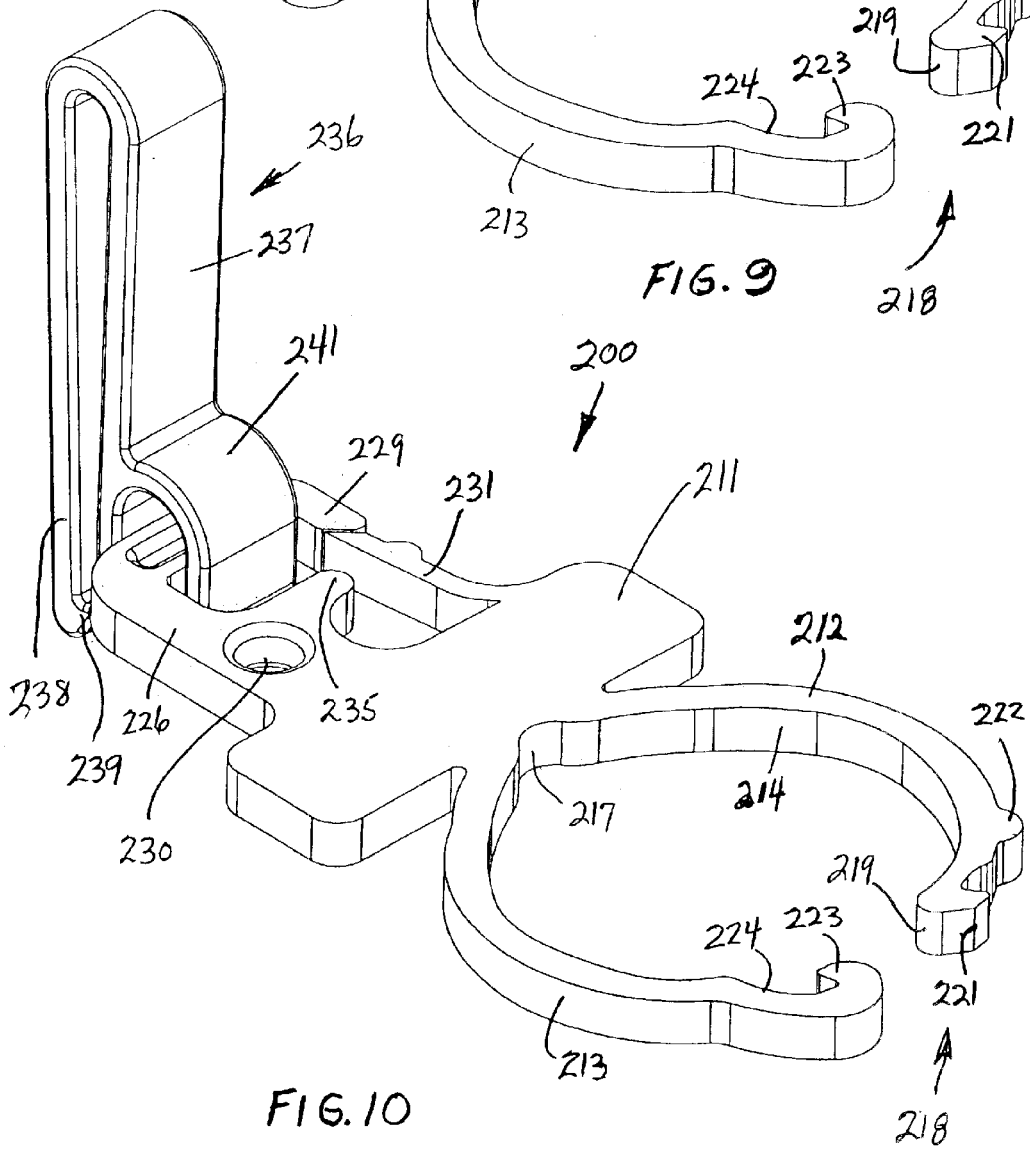
FIG. 10 is a perspective view of the bottle holder of FIG. 9 connected to a belt clip.
Figure 11:
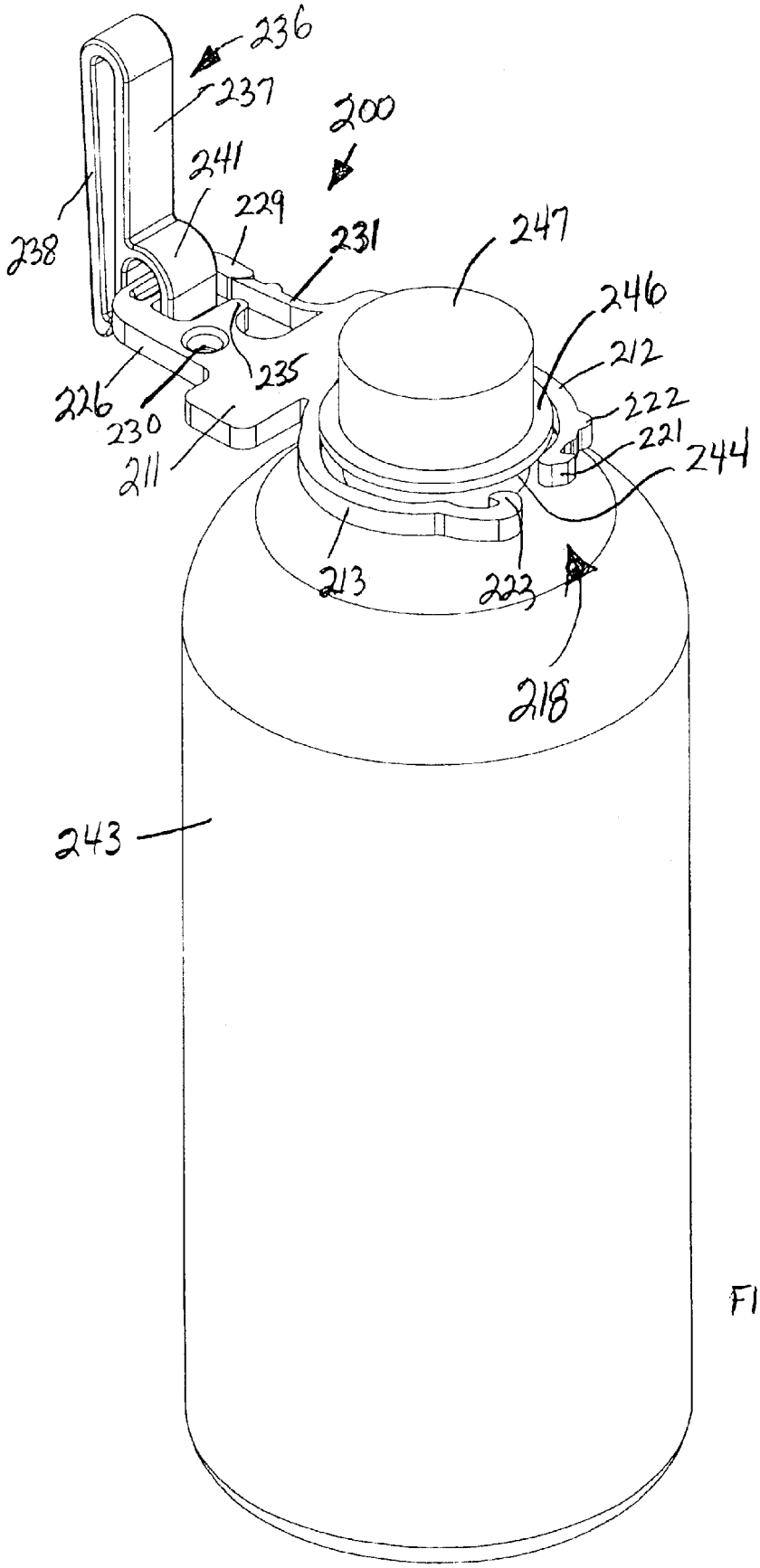
FIG. 11 is a perspective view of the bottle holder and belt clip of FIG. 9 with the holder connected to the neck of a bottle.

A second modification of the holder, indicated generally at 200, shown in FIGS. 9 to 11, is a one-piece plastic or metal device adapted to be connected to the neck of a bottle. The parts of holder 200 that correspond to the parts of holder/ 10 have the same reference number with a prefix 2. Body 211 is a flat rectangular member joined to legs 212 and 213, arm 226 and lip 231. The flat outside surfaces of the rectangular member may accommodate logos, designs, printed materials, labels, and other indicia. Arm 226 has a hole 230 to accommodate a cord, chain, key ring and other items that can extend through hole 230. The inside of arm 226 has a stop projection 235 extended toward lip 231. Projection 235 limits inward movement of lip 231.

Figure 12:
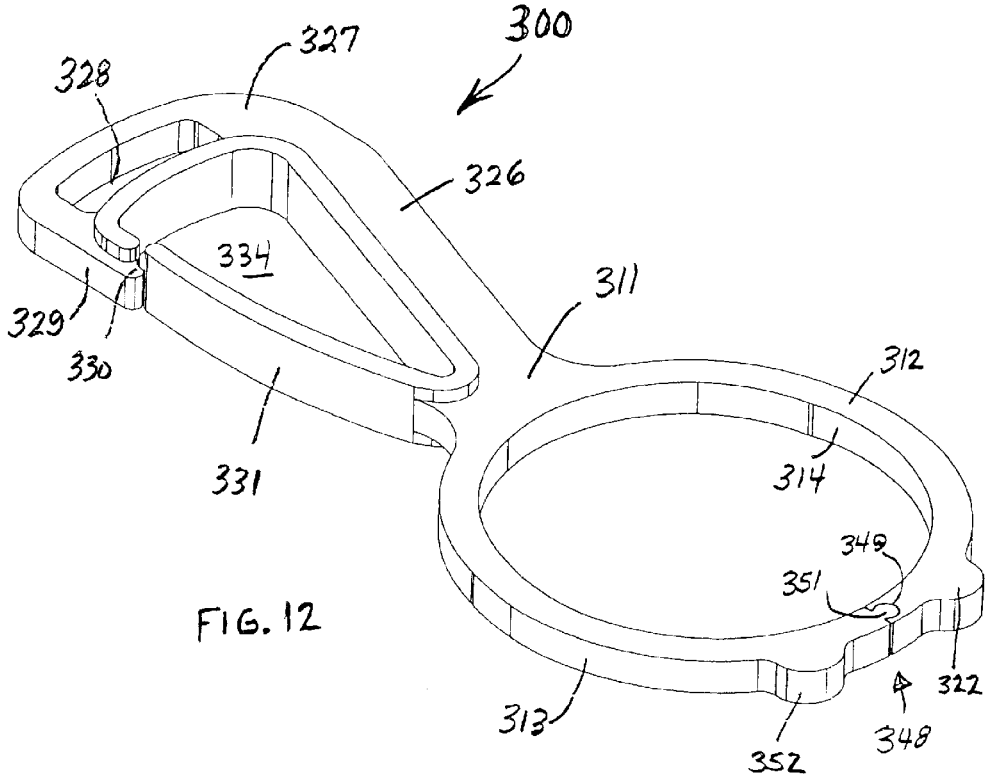
FIG. 12 is a perspective view of a third modification of the releasable bottle holder of the invention.
Figure 13:
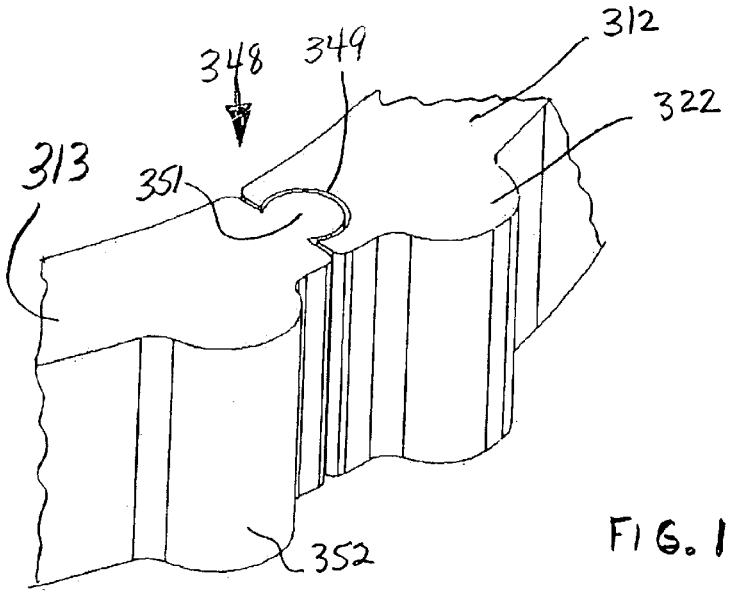
FIG. 13 is an enlarged perspective view of the releasable latch of the releasable bottle holder of FIG. 12.
Figure 14:
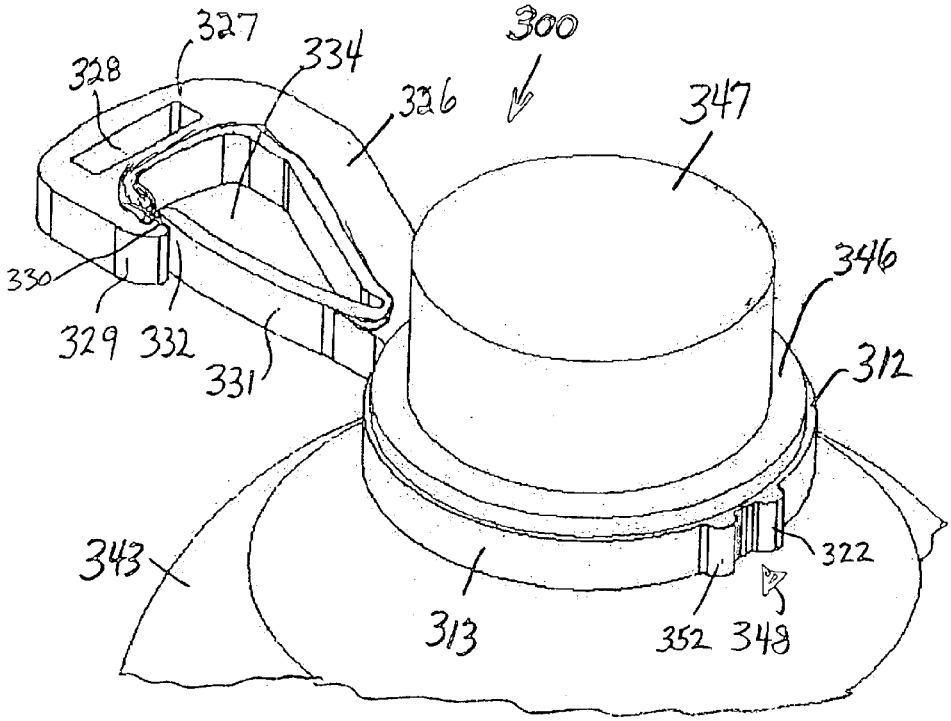
FIG. 14 is a perspective view of the releasable bottle holder of FIG. 12 connected to the neck of a bottle.

A third modification of the holder, indicated generally at 300 in FIGS. 12 to 14, is a flat one-piece plastic or metal device adapted to be connected to the neck of a bottle. The parts of holder 300 that correspond to holder 10 shown in FIGS. 1 to 6 have the same reference numbers with the prefix 3. The outer or free ends of legs 312 and 313 are joined to a releasable latch 348 comprising a semi-cylindrical groove or socket 349 in the end of leg 312 and a semi-cylindrical projection 351 on the end of leg 313. The outer end of leg 313 has an outside boss 352 used as an abutment to apply force to leg 313 to snap projection 351 into socket 349 and retract projection 351 from socket 349.

Figure 15:
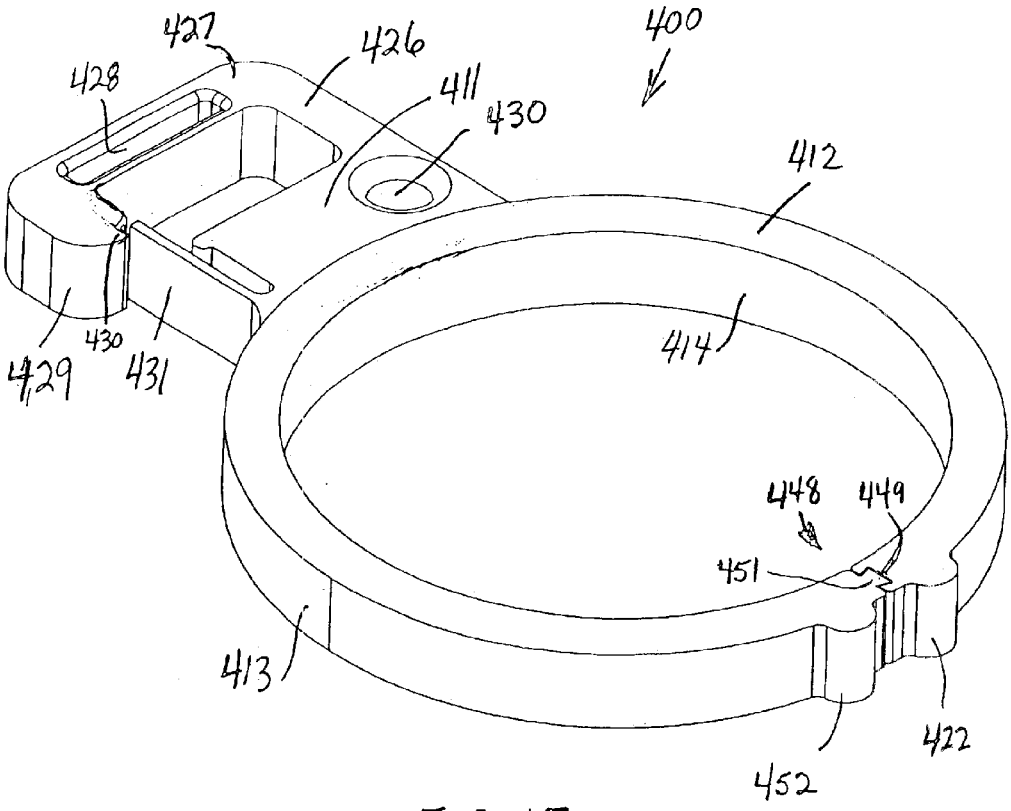
FIG. 15 is a perspective view of a fourth modification of the releasable bottle holder of the invention.

A fourth modification of the holder, indicated generally at 400 in FIG. 15, is a flat one-piece plastic or metal device adapted to be connected to a bottle. The parts of holder 400 that correspond to the parts of holder 10 shown in FIGS. 1 to 6 have the same reference number with the prefix 4. Body 411 is a generally rectangular member having a hole 430. The outer ends of legs 412 and 413 have a releasable latch 448 comprising an under cut groove 449 in the end of leg 412 and a dove tail projection 451 in the end of leg 413. The outer end of leg 413 has a boss 452. Leg contracting forces applied to bosses 422 and 452 retain projection 451 in groove 449. Legs 412 and 413 are expanded and place around the neck of a bottle. Bosses 422 and 452 are moved up and down to align projection 451 with groove 449 to allow projection 451 to slide into groove 449 thereby connecting legs 412 and 413. Up and down forces are applied to bosses 422 and 452 to move projection 451 out of groove 449 to allow legs 412 and 413 to move outwardly to open positions. Legs 412 and 413 are then biased outwardly to release holder 400 from the bottle.

Figure 16:
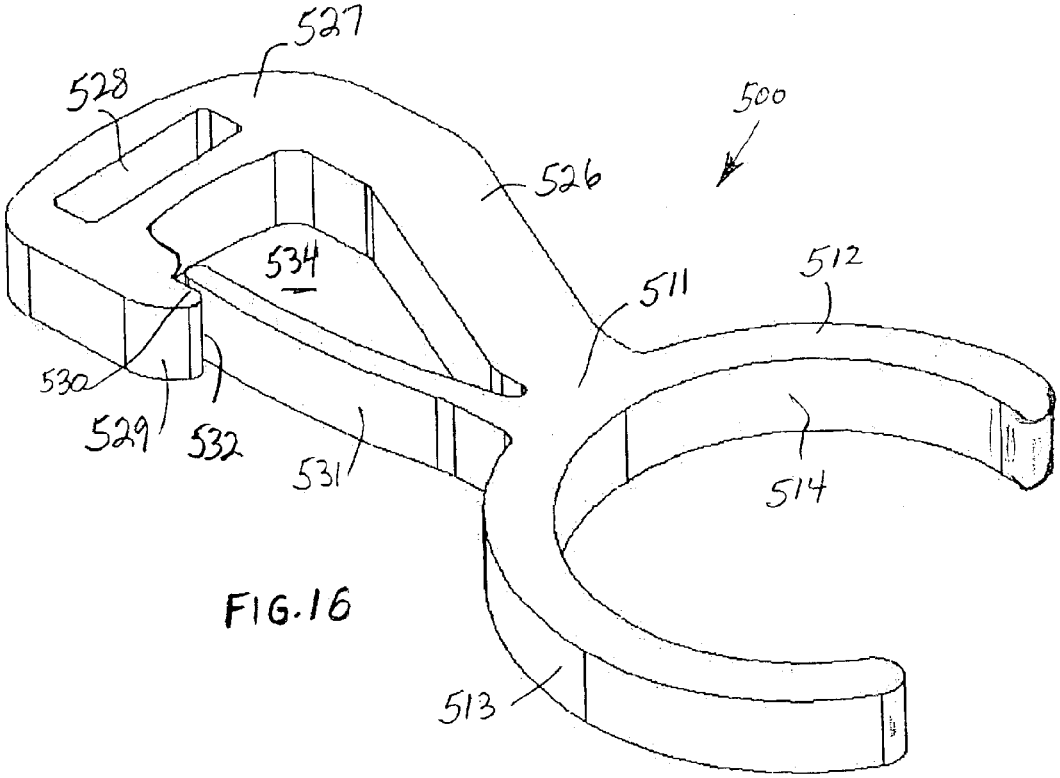
FIG. 16 is a perspective view of a fifth modification of the releasable bottle holder of the invention.
Figure 17:
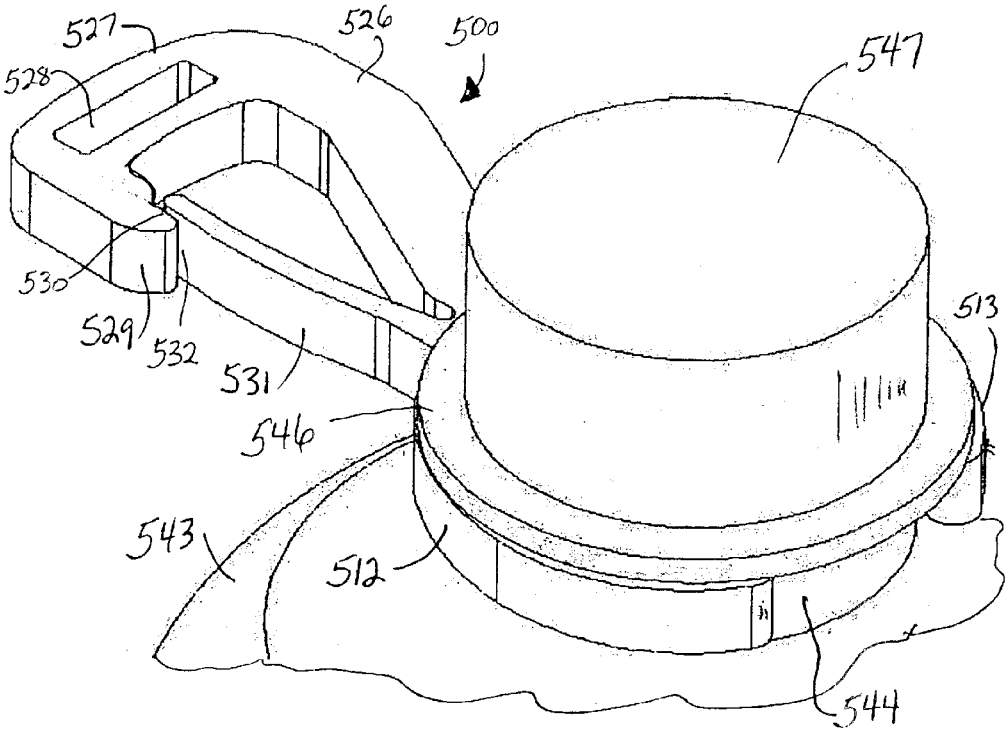
FIG. 17 is a perspective view of the releasable bottle holder of FIG. 16 connected to the neck of a bottle.

A fifth modification of the holder, indicated generally at 500 in FIGS. 16 and 17, is a flat one-piece plastic or metal device adapted to be connected to a bottle. The parts of holder 500 that correspond to holder 10 shown in FIGS. 1 to 6 have the same reference number with a prefix 5. The outer ends of legs 512 and 513 do not have a releasable latch. Legs 512 and 513 are spring biased into clamping engagement with opposite arcuate portions of neck 544 of bottle 543 to retain holder 500 in assembled relation with bottle 543.

Figure 18:
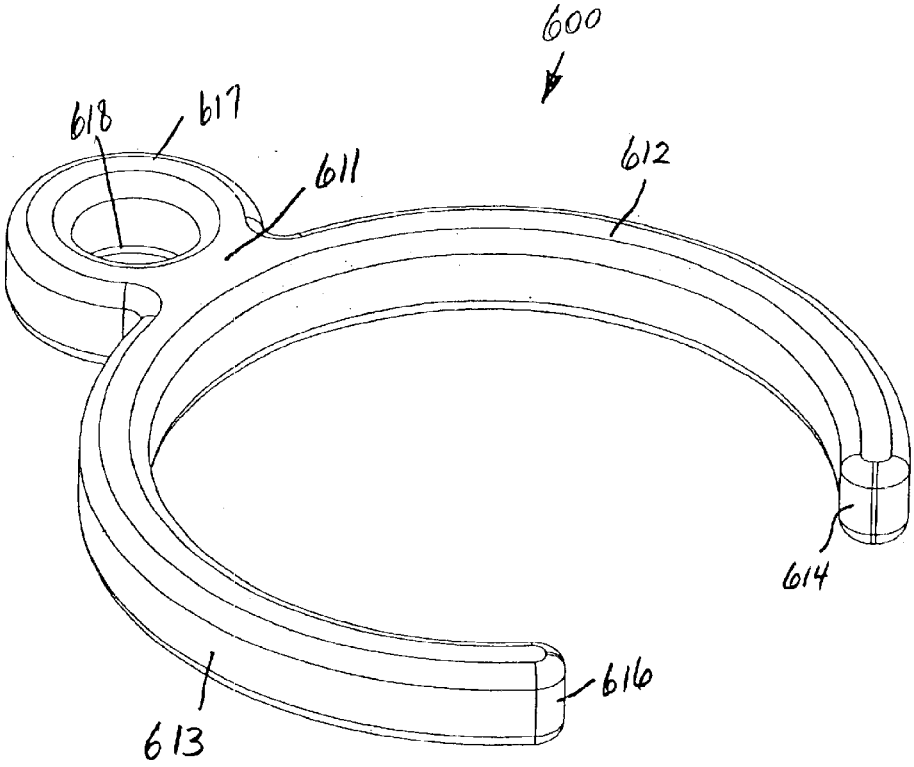
FIG. 18 is a perspective view of a sixth modification of the releasable bottle holder of the invention.

A sixth modification of the holder, indicated generally at 600 in FIG. 18, is a one-piece plastic or metal device adapted to be clamped onto the neck of a bottle. Holder 600 has convex curved arms 612 and 613 joined to a body 611. The outer ends 614 and 616 are spaced from each other to allow arms 612 and 613 to be clamped onto the cylindrical neck of a bottle. An annular ring 617 having a hole 618 is joined to body 611.

Figure 19:
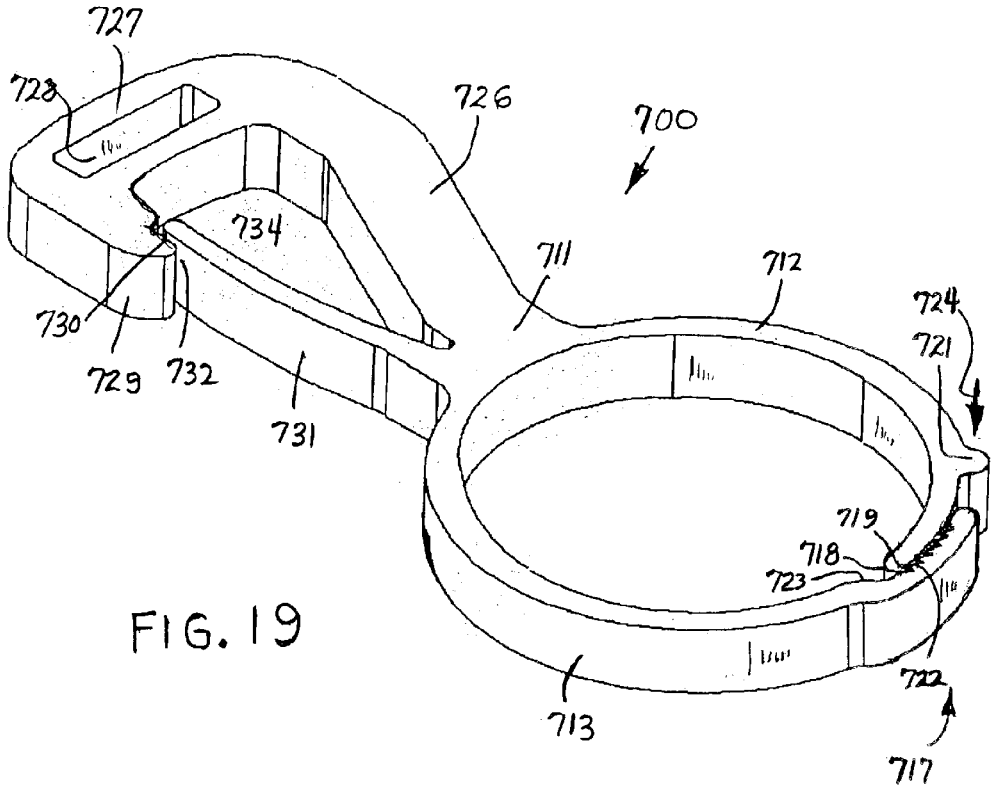
FIG. 19 is a perspective view of a seventh modification of the releasable bottle holder of the invention.
Figure 20:
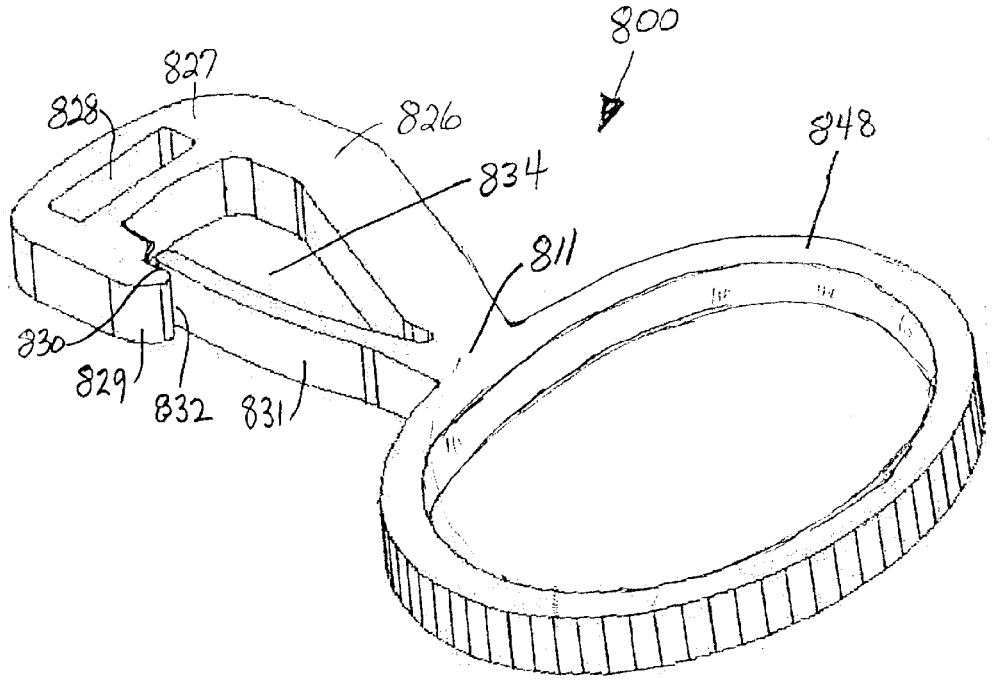
FIG. 20 is a perspective view of an eighth modification of the releasable bottle holder of the invention.
Figure 21:
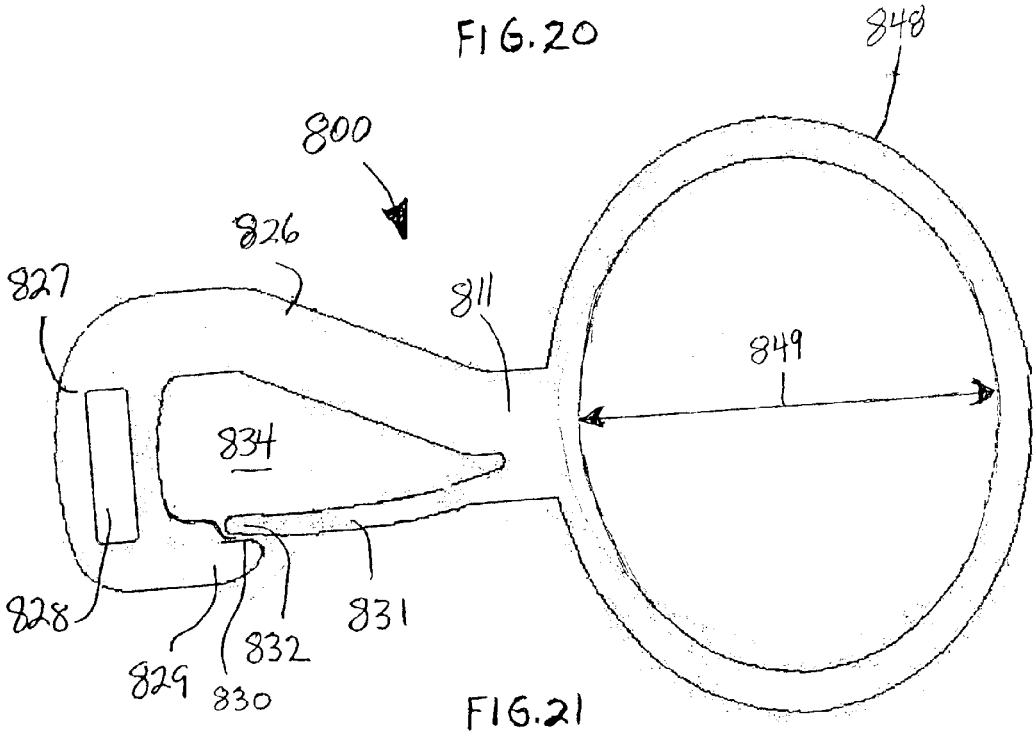
FIG. 21 is a top plan view of FIG. 20.

A seventh modification of the holder, indicated generally at 700 in FIG. 19, is a one-piece plastic or metal device adapted to be clamped on the neck of a bottle. The parts of holder 700 that correspond to holder 10 shown in FIGS. 1 to 6 have the same reference numbers with a prefix 7. Opposite outwardly curved legs 712 and 713 joined to body 711 have adjacent ends with a cooperating adjustable releasable latch 717. The outer end of leg 712 has a convex surface 718 and an outwardly extended transverse projection 719. A boss 721 located circumferentially inwardly from projection 719 functions as an abutment to apply force, shown by arrow 724, on leg 712 to release latch 717. The end of leg 713 has a plurality of circumferentially spaced transverse teeth 722 which function as hooks engageable with projection 719 to hold legs 712 and 713 in a closed clamping position about the neck of a bottle. Teeth 722 are circumferentially spaced from each other to provide adjustment of the clamping force of legs 712 and 713 on the neck of a bottle. Leg 713 has an inside inclined surface 723 aligned with the convex end surface 718 of leg 712. When force is applied to boss 721 as shown by arrow 724 surface 718 rides on surface 723 to move projection 719 out of engagement with holding teeth 722 whereby legs 712 and 713 expand to their open positions out of clamping relation with the neck of a bottle.

Figure 22:
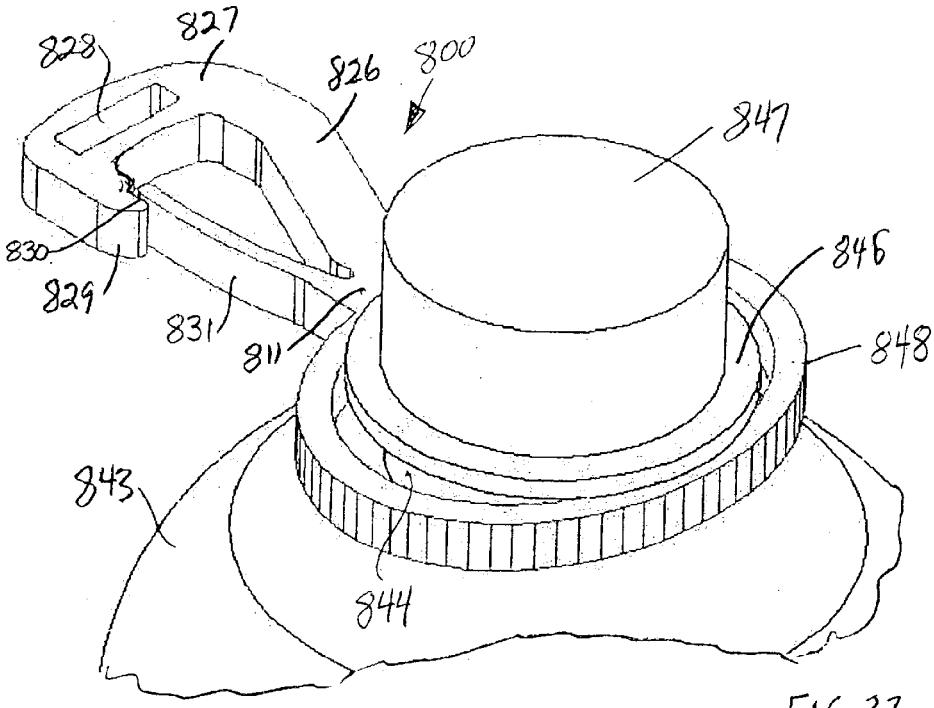
FIG. 22 is a perspective view of the releasable bottle holder of FIG. 20 connected to the neck of a bottle.
Figure 23:
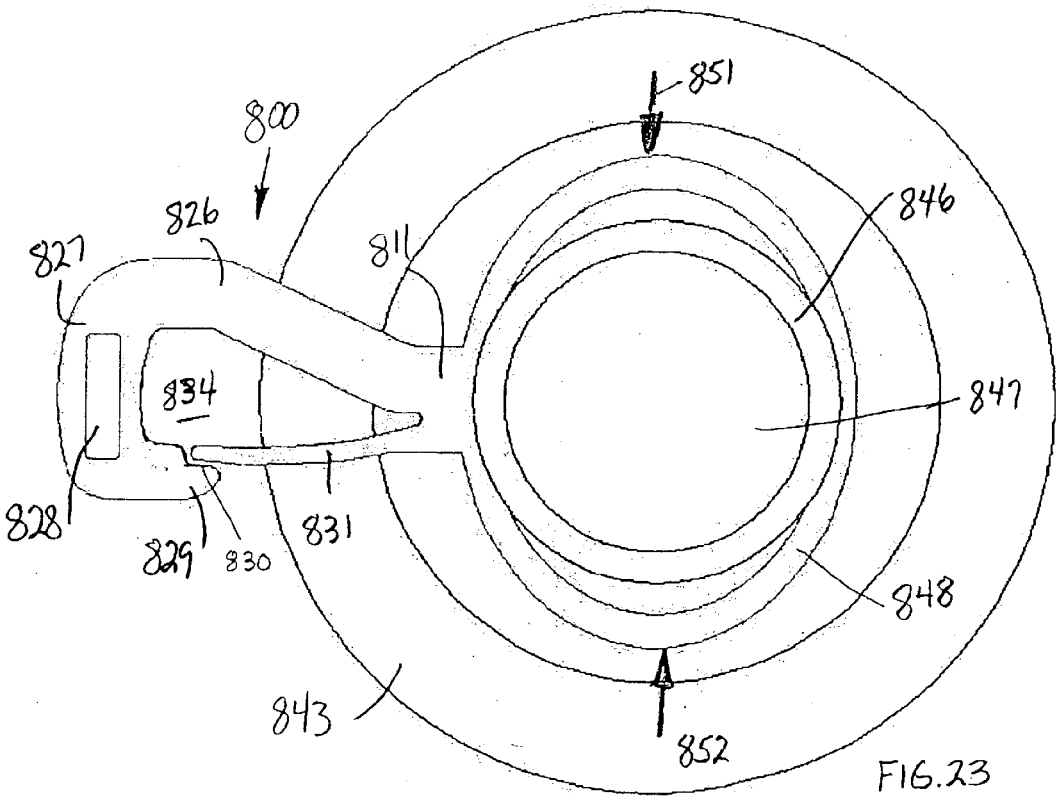
FIG. 23 is a top plan view of FIG. 22.

An eighth modification of the holder, indicated generally at 800 in FIGS. 20 to 23, is a one-piece plastic or metal device adapted to be connected to the neck of a bottle. The parts of holder 800 that correspond to holder 10 of FIGS. 1 to 6 have the same reference numbers with the prefix 8. An oval shaped ring 848 joined to the base of body 811 has a minor diameter 849 smaller than the diameter of the neck of a bottle. As shown in FIGS. 22 and 23, ring 848 is located below opposite segments of bottle flange 846. The minor diameter of sections of ring 848 are biased into tight engagement with neck 844 to connect holder 800 to bottle 843. Ring 848 is released from neck 844 by applying opposite forces, shown by arrows 851 and 852 in FIG. 23, on the major axis segments of ring 848 to expand the minor axis segments of ring 848. When the minor axis segments of ring 848 clears flange 846 the ring can be lifted over flange 846 and removed from bottle 843.

Figure 24:
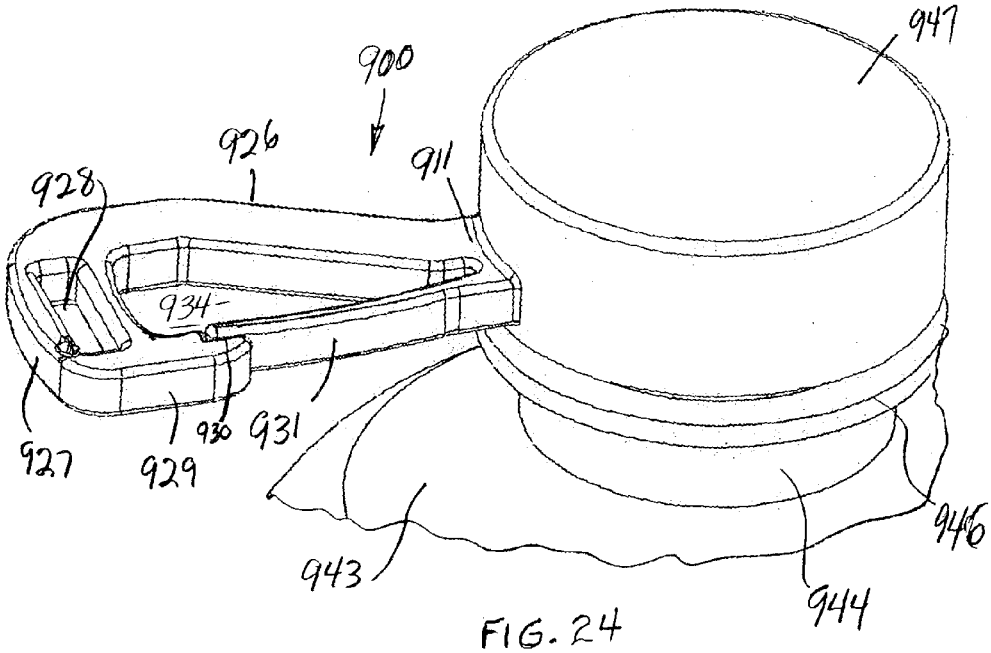
FIG. 24 is a perspective view of a ninth modification of the releasable bottle holder of the invention connected to a bottle.
Figure 25:
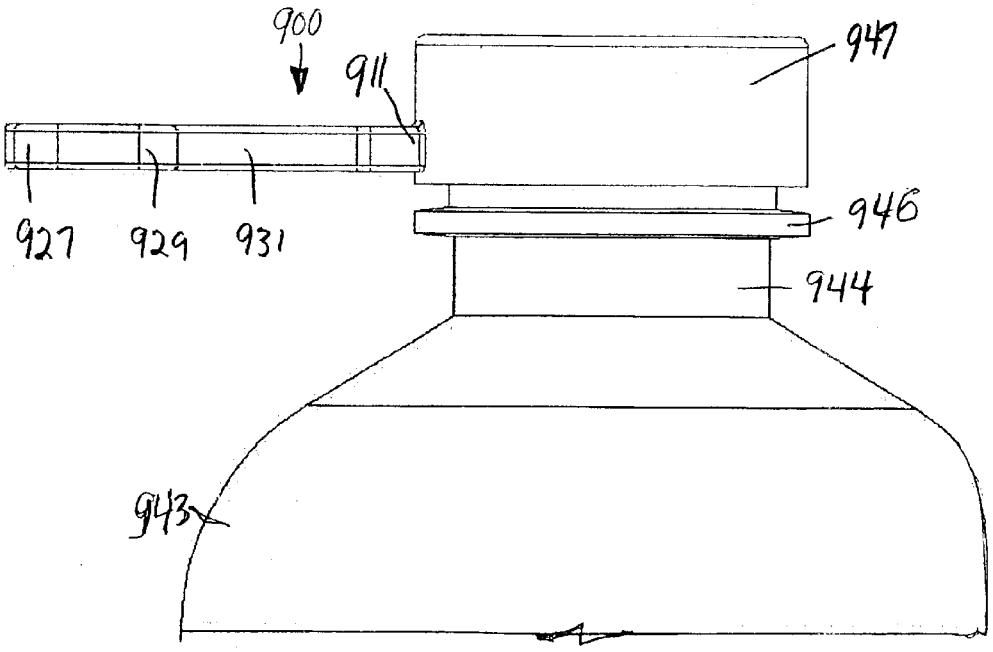
FIG. 25 is a side elevational view of FIG. 24.
Figure 26:
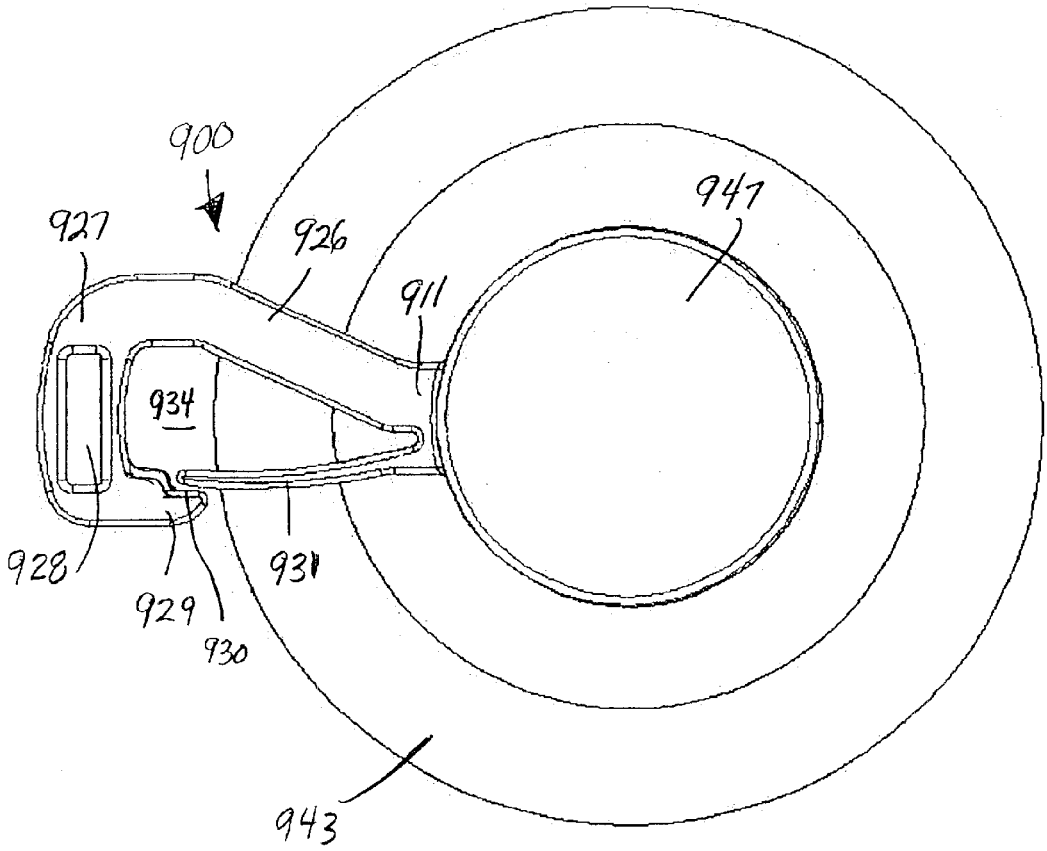
FIG. 26 is a top plan view of FIG. 24.

A ninth modification of the bottle holder, indicated generally at 900 in FIGS. 24 to 26, is a combination of a bottle cap 947 and a clasp. The clasp is a releasable fastener having an arm 926 joined to a transverse head 927. Head 927 has an elongated slot 928 and an inwardly directed ear 929. A flexible finger 931 joined to body 911 extends outwardly to close eye 934 of the clasp. Body 911 is joined to the side wall of cap 947. Cap 947 and the clasp is a one-piece plastic structure.

Figure 27:
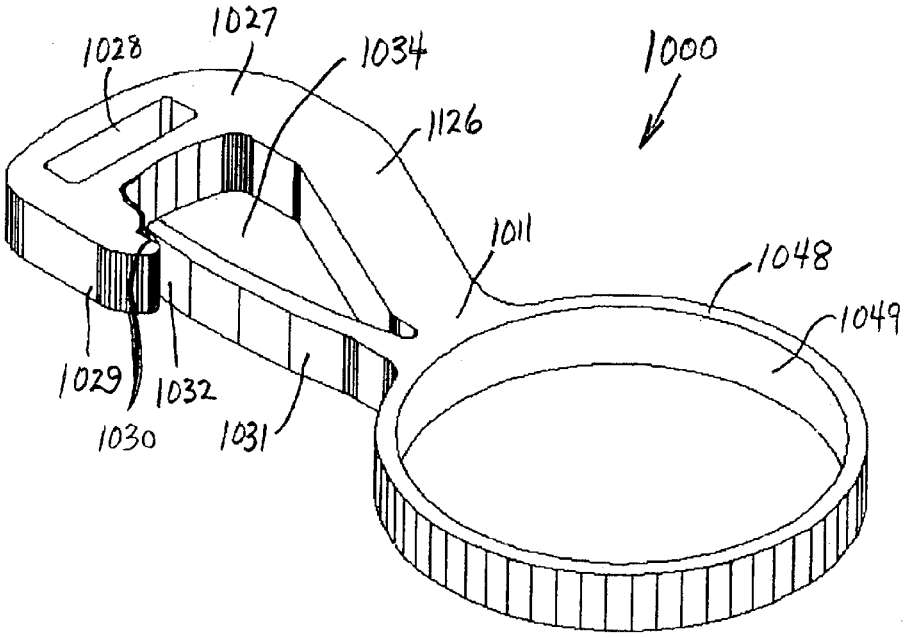
FIG. 27 is a perspective view of a tenth modification of the bottle holder.

A tenth modification of the bottle holder, indicated generally at 1000 in FIG. 27, is a one-piece plastic or rubber-like device adapted to be positioned around the neck of a bottle to retain the bottle in a desired location. The parts of holder 1000 that correspond to holder 10 of FIGS. 1 to 6 have the same reference number with the prefix 10. A cylindrical ring or band 1048 is joined to the base of body 1011. Band 1048 has a continuous inside cylindrical surface 1049 with a diameter smaller than the outside diameter of the neck of a conventional water or beverage bottle. For example, the diameter of surface 1049 is less than 2.5 cm when holder 1000 is used with a conventional bottle having a neck outside diameter of 2.5 cm. Band 1048 is an expandable flexible rubber or plastic material that can be expanded to place band 1048 around the neck of a bottle. The memory of the material of band 1048 retains surface 1049 in firm surface engagement with the neck of the bottle thereby connecting holder 1000 to the bottle.

Figure 28:
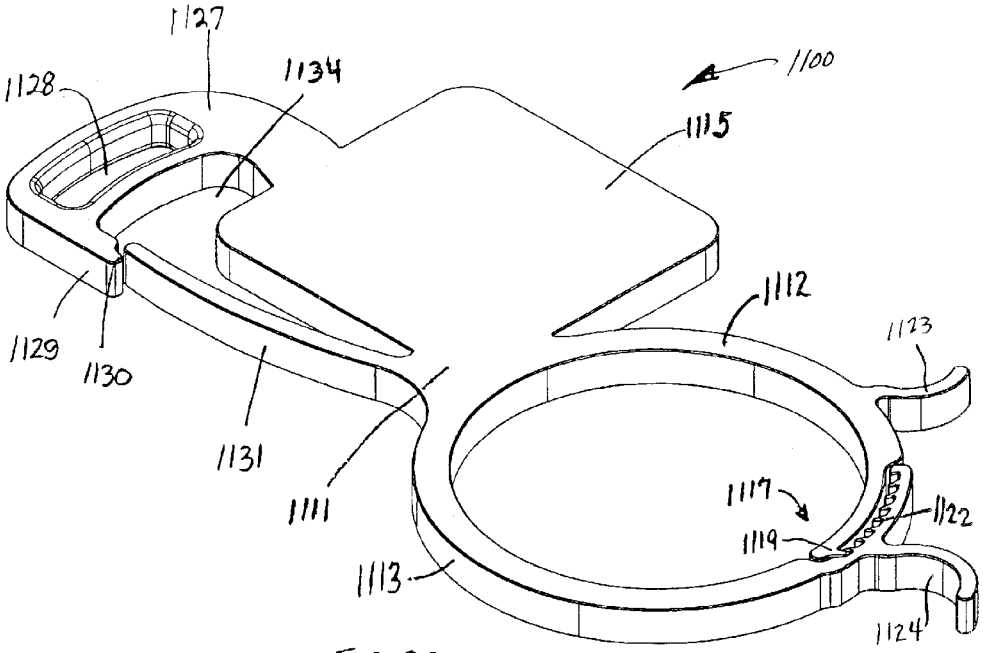
FIG. 28 is a perspective view of an eleventh modification of the releasable bottle holder.

An eleventh modification of the holder, indicated generally at 1100, shown in FIG. 28, is a one-piece plastic or metal device adapted to be connected to the neck of a bottle. The parts of holder 1100 that correspond to holder 10 shown in FIGS. 1 to 6 have the same reference number with a prefix 1. Body 1111 includes a transverse flat rectangular member 1115 with exposed flat outer rectangular surfaces. Logos, designs, printed materials, labels and other visual indicia may be applied to or mounted on the flat surface of member 1115. The releasable connector 1117 has cooperating teeth 1119 and 1122. Curved finger members 1123 and 1124 on legs 1112 and 1113 are manually moved toward each other to release the cooperating teeth 1119 and 1122 to allow legs 1112 and 1113 to spring open.

Figure 29:
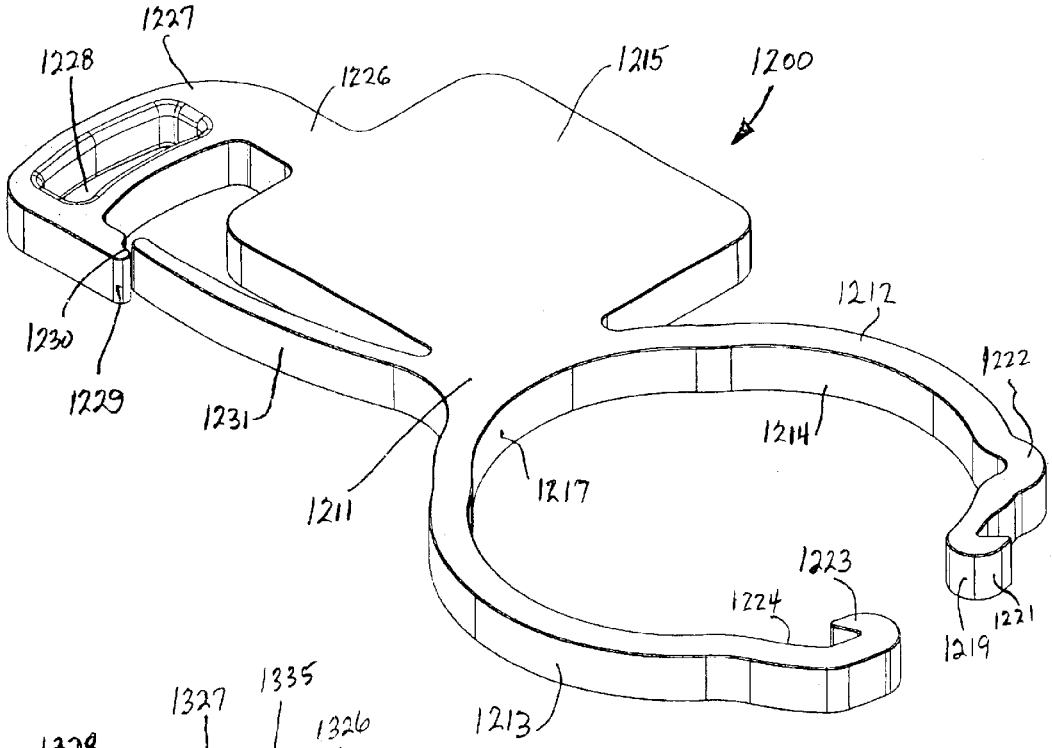
FIG. 29 is a perspective view of a twelfth modification of the releasable bottle holder.

A twelfth modification of the holder, indicated generally at 1200, shown in FIG. 29, is a one-piece plastic or metal device adapted to be connected to the neck of a bottle. The parts of holder 1200 that correspond to holder 10 shown in FIGS. 1 to 6 have the same reference number with a prefix 1. Body 1211 includes a transverse flat square member 1215 with exposed flat outer rectangular surfaces. Logos, designs, printed materials, labels and other visual indicia may be applied to or mounted on the flat surface of member 1215.

Figure 30:
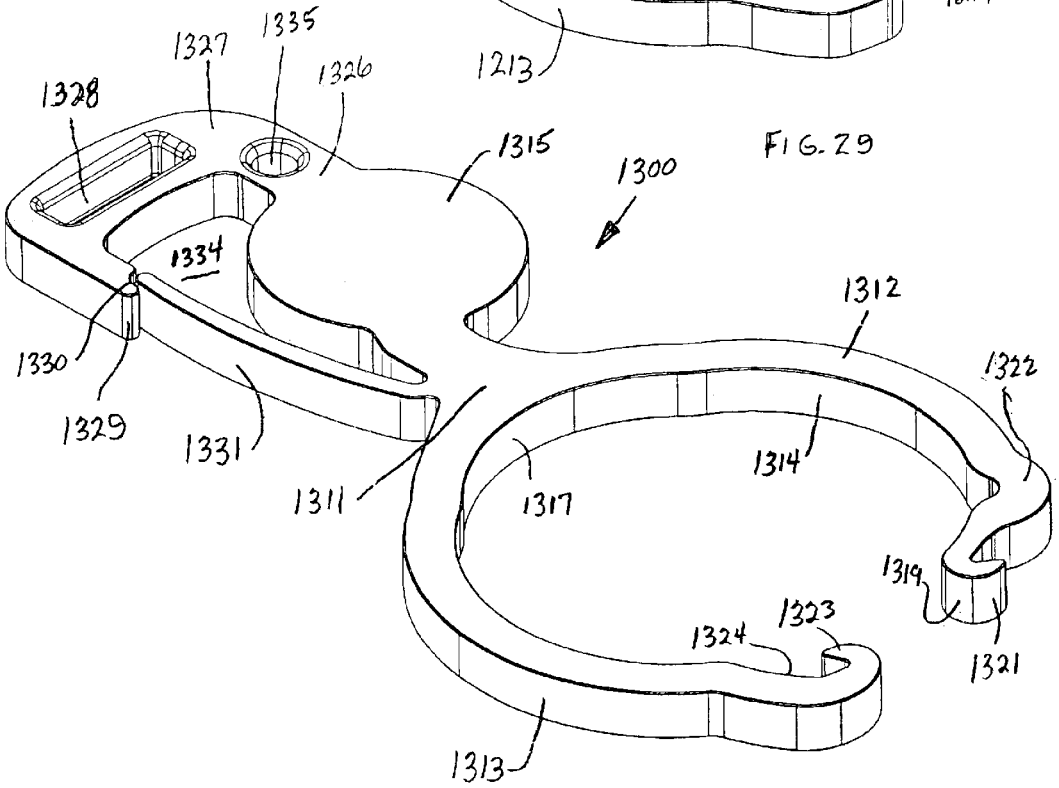
FIG. 30 is a perspective view of a thirteenth modification of the releasable bottle holder.

A thirteenth modification of the holder, indicated generally at 1300, shown in FIG. 30, is a one-piece plastic or metal device adapted to be connected to the neck of a bottle. The parts of holder 1300 to holder 10 shown in FIGS. 1 to 6, have the same reference number with a prefix 1. Body 1311 includes a transverse flat cylindrical member 1315 with exposed flat outer circular surfaces. Logos, designs, printed materials, labels and other visual indicia may be applied to or mounted on the flat surface of member 1315. Arm 1326 has a hole 1335 adapted to accommodate a chain or ring for holding keys and like objects.

The bottle holder disclosed herein can be embodied in other specific forms without departing from the invention. The shape, arrangement of shapes and parts, size of the holder and materials of the holder can be altered by one skilled in the art within the confines of the invention.

What is claimed is:

1. A holder for a bottle having a cylindrical neck, comprising: a body, a pair of convex curved flexible legs joined to the body, each of said legs having a concave curved inside surface adapted to engage cylindrical portions of the neck to secure the holder to the bottle, said legs having adjacent outer ends, a releasable latch joined to said adjacent outer ends for connecting said adjacent ends of the legs to selectively retain the concave curved inside surfaces of the legs in engagement with the cylindrical neck of the bottle and release said concave curved inside surfaces from engagement with the cylindrical neck of the bottle whereby the holder can be removed from the cylindrical neck of the bottle, said body having a concave curved wall between and joined to the concave curved inside surfaces of the legs providing a concave recess, said concave curved wall of the body having a curvature radius smaller than the curvature radii of the concave curved inside surfaces of the legs whereby a portion of said neck of the bottle is movable into said concave recess to allow said latch to be released, an arm joined to the body extended longitudinally away from the legs, a head joined to the arm, an ear joined to the head and laterally spaced from the arm providing an eye, a flexible lip joined to the body and laterally spaced from the arm, said lip having an outer end portion engageable with the ear to close the eye, and a generally flat member joined to the arm having at least one surface for accommodating indicia.

2. The holder of claim 1 wherein: said latch includes an outwardly directed projection on one leg and an inwardly directed hook on the other leg, said hook being engageable with said projection for connecting said adjacent ends of the legs.

3. The holder of claim 1 including: a transverse slot located in said head.

4. The holder of claim 1 including: a hole located in said arm.

5. The holder of claim 1 wherein: said member has a generally rectangular shape.

6. The holder of claim 1 wherein: the member has a generally circular shape.

7. The holder of claim 1 wherein: said latch comprising a groove in the end of one leg, and a projection in the end of the other leg, said projection being located in said groove to connect said adjacent outer ends of the legs.

8. The holder of claim 1 wherein: said latch comprising at least one projection on one outer end of one leg, and a plurality of teeth on the other outer end of the other leg, said projection engageable with one of the teeth to connect the outer ends of said legs.

9. The holder of claim 8 including: an outwardly projected knob joined to one of said legs useable to facilitate manual release of the teeth from the projection thereby releasing said legs from the neck of the bottle.

10. The holder of claim 1 wherein: said latch has an inwardly directed hook on an outer end of one of said legs, an outwardly directed projection on an outer end of the other leg, said hook and projection being engageable to retain said concave curved inside surfaces of the legs in engagement with the neck of the bottle, and an outwardly projected knob joined to one of said legs useable to facilitate manual release of said latch.

11. The holder of claim 1 wherein: said latch has at least one tooth on an outer end of one said legs, a plurality of teeth on an outer end of the other leg, said tooth being engageable with one of said teeth to retain said concave curved inside surfaces of the legs in engagement with the neck of the bottle, and an outwardly projected knob joined to one of said legs useable to facilitate manual release of said latch.

12. A holder for a bottle having a cylindrical neck, comprising: a body, a pair of convex curved flexible legs joined to the body, each of said legs having a concave curved inside surface adapted to engage a cylindrical portion of the neck to secure the holder to the bottle, said legs having adjacent outer ends, a releasable latch joined to said adjacent outer ends for connecting said adjacent ends of the legs to selectively retain the concave curved inside surfaces of the legs in engagement with the cylindrical neck of the bottle and release said concave curved inside surfaces from engagement with the cylindrical neck of the bottle whereby the holder can be removed from the cylindrical neck of the bottle, said body having a concave curved wall between and joined to the concave curved inside surfaces of the legs providing a concave recess, said concave curved wall of the body having a curvature radius smaller than the curvature radii of the concave curved inside surfaces of the legs whereby a portion of said neck of the bottle is movable into said concave recess to allow said latch to be released, an arm joined to the body adjacent the concave curved wall and extended longitudinally away from the legs, a head joined to the arm, a slot in said head, an ear joined to the head and laterally spaced from the arm providing an eye, and a flexible lip joined to the body and laterally spaced from the arm, said lip, having an outer end portion engageable with the ear to close the eye.

13. The holder of claim 12 wherein: said latch includes an outwardly directed projection on one leg and an inwardly directed hook on the other leg, said hook being engageable with said projection for connecting said adjacent ends of the legs.

14. The holder of claim 13 including: an outwardly projected knob joined to one of said legs useable to facilitate manual release of the hook from the projection thereby releasing said legs from the neck of the bottle.

15. The holder of claim 12 wherein: said latch comprises a groove in the end of one leg, and a projection in the end of the other leg, said projection being located in said groove to connect said adjacent outer ends of the legs.

16. The holder of claim 15 including: an outwardly projected knob joined to one of said legs useable to facilitate manual release of the projection from the groove thereby releasing said legs from the neck of the bottle.

17. The holder of claim 12 wherein: said latch comprises at least one projection on an outer end of one leg, and a plurality of teeth on an outer end of the other leg, said projection engageable with one of the teeth to connect the outer ends of said legs.

18. The holder of claim 12 wherein: said latch has at least one tooth on an outer end of one leg, a plurality of teeth on an outer end of the other leg, said tooth being engageable with one of said teeth to retain said concave curved inside surfaces of the legs in engagement with the neck of the bottle, and an outwardly projected knob joined to one of said legs useable to facilitate manual release of said latch.

19. A holder for a bottle having a neck, comprising: a body, a pair of convex flexible legs joined to the body, each of said legs having a concave curved inside surface adapted to engage a portion of the neck to secure the holder to the bottle, said legs having adjacent outer ends, a releasable latch joined to said adjacent outer ends for connecting said adjacent ends of the legs to selectively retain the concave curved inside surfaces of the legs in engagement with the neck of the bottle and release said concave curved inside surfaces from engagement with the neck of the bottle whereby the holder can be removed form the neck of the bottle, said body having a concave curved wall between and joined to the concave curved inside surfaces of the legs providing a concave recess for accommodating a portion of the neck of the bottle to allow said latch to be released, an arm joined to the body extended longitudinally away from the legs, a head joined to the head, an ear joined to the head and laterally spaced from the arm providing an eye, and a flexible lip joined to the body and laterally spaced from the arm, said lip having an outer end portion engageable with the ear to close the eye.

20. The holder of claim 19 including: a member joined to the arm having at least one surface for accommodating indicia.

21. The holder of claim 19 wherein: said member has a generally rectangular shape.

22. The holder of claim 19 wherein: the member has a generally circular shape.

23. The holder of claim 19 wherein: said latch includes an outwardly directed projection on one leg and an inwardly directed hook on the other leg, said hook being engageable with said projection for connecting said adjacent ends of the legs.

24. The holder of claim 19 wherein: said latch comprises a groove in the end of one leg, and a projection in the end of the other leg, said projection being located in said groove to connect said adjacent outer ends of the legs.

25. The holder of claim 19 said latch comprises at least one projection on one outer end of one leg, and a plurality of teeth on the other outer end of the other leg, said projection engageable with one of the teeth to connect the outer ends of said legs.

26. The holder of claim 25 including: an outwardly projected knob joined to a leg useable to facilitate manual release of the teeth from the projection thereby releasing said legs from the neck of the bottle.

27. The holder of claim 19 wherein: said latch has an inwardly directed hood on an outer end of one leg, an outwardly directed projection on an outer end of the other leg, said hook and projection being engageable to retain said concave curved inside surfaces of the legs in engagement with the neck of the bottle, and an outwardly projected knob joined to one of said legs useable to facilitate manual release said latch.

28. The holder of claim 19 wherein; said latch has at least one tooth on an outer end of one leg, a plurality of teeth on an outer end of the other leg, said being engageable with one of said teeth to retain said concave curved inside surfaces of the legs in engagement with the neck of the bottle, and an outwardly leg useable to facilitate manual release of said latch.

* * * * *